US012193565B2

(12) United States Patent
Scanlon et al.

(10) Patent No.: US 12,193,565 B2
(45) Date of Patent: Jan. 14, 2025

(54) POLE CADDIES WITH ADJUSTABLE BASKET BRACKETS

(71) Applicant: Decolin Inc., Montreal (CA)

(72) Inventors: Benjamin Scanlon, Philadelphia, PA (US); Frank Coratolo, Blackwood, NJ (US); Cameron Kawika Dye, Media, PA (US)

(73) Assignee: Decolin Inc., Montreal (CA)

( * ) Notice: Subject to any disclaimer, the term of this patent is extended or adjusted under 35 U.S.C. 154(b) by 0 days.

(21) Appl. No.: 17/534,867

(22) Filed: Nov. 24, 2021

(65) Prior Publication Data

US 2022/0160123 A1 May 26, 2022

Related U.S. Application Data

(60) Provisional application No. 63/118,506, filed on Nov. 25, 2020.

(51) Int. Cl.
*A47B 45/00* (2006.01)
*A47K 3/28* (2006.01)

(52) U.S. Cl.
CPC ..... *A47B 45/00* (2013.01); *A47K 3/281* (2013.01)

(58) Field of Classification Search
CPC ..... A47B 45/00; A47B 57/54; A47B 96/1425; A47K 3/281
See application file for complete search history.

(56) References Cited

U.S. PATENT DOCUMENTS 1,625,935 A * 4/1927 Cox ..... D06F 81/006 211/153
2,849,249 A * 8/1958 Fridolph ..... F16B 7/1454 403/376
2,977,953 A * 4/1961 Miller ..... A47J 37/0763 126/30
4,596,484 A * 6/1986 Nakatani ..... F16M 11/28 403/109.5
5,013,177 A * 5/1991 Sol ..... F16B 2/185 403/374.5
5,154,449 A * 10/1992 Suei-Long ..... F16B 7/1454 285/298
6,017,009 A * 1/2000 Swartz ..... A47B 57/10 248/245
6,113,042 A * 9/2000 Welsch ..... A47B 57/265 211/187
6,142,699 A * 11/2000 Pao ..... F16B 7/1454 403/109.5
6,481,586 B1 * 11/2002 Hoff ..... A47B 57/26 211/90.02

(Continued)

*Primary Examiner* — Stanton L Krycinski
(74) *Attorney, Agent, or Firm* — Alan G. Towner; Leech Tishman Fuscaldo & Lampl

(57) ABSTRACT

Pole caddies with adjustable basket brackets are disclosed that allow one or more baskets to be moved along the length of the pole and secured at desired heights. The adjustment bracket includes a cylindrical body with a central tube-receiving hole in which the pole is inserted. A bracket lever pivotally mounted on the body of the bracket is movable from a closed position in contact with the pole to an open position that allows the adjustable bracket to slide along the pole. The caddy pole may include a tension locking mechanism to hold the caddy in place when installed, and may include one or more tube sections.

16 Claims, 14 Drawing Sheets

(56) References Cited

U.S. PATENT DOCUMENTS 6,688,238 B1 * 2/2004 Alexiou ..... A47K 3/281 108/42
6,719,259 B2 * 4/2004 Huang ..... A47B 96/061 248/407
7,060,040 B2 * 6/2006 Farmer ..... A47G 1/0638 600/573
7,086,633 B2 * 8/2006 Welch ..... A47B 57/265 248/245
7,341,230 B2 * 3/2008 Beaudry ..... A47G 7/044 248/315
7,401,754 B2 * 7/2008 Welch ..... A47B 57/545 211/187
7,527,600 B2 * 5/2009 Farmer ..... F16B 9/058 403/93
8,225,946 B2 * 7/2012 Yang ..... A47K 17/00 108/108
8,702,339 B2 * 4/2014 Ballentine ..... F16B 7/1454 403/109.5
8,763,821 B2 * 7/2014 Yang ..... A47B 57/26 248/235
9,107,496 B2 * 8/2015 Lindo ..... A47K 3/281
9,339,151 B2 * 5/2016 Yang ..... A47K 3/281
9,357,860 B1 * 6/2016 Klowan ..... A47K 3/281
9,693,660 B1 * 7/2017 Stelmarski ..... A47K 3/281
9,883,742 B2 * 2/2018 Yang ..... A47B 57/26
9,943,192 B2 * 4/2018 Yang ..... A47K 3/281
10,034,587 B1 * 7/2018 Elliot ..... A47K 3/281
10,890,291 B2 * 1/2021 Sisto ..... A47G 29/087
10,959,517 B2 * 3/2021 Elliott ..... F16B 2/185
11,118,709 B2 * 9/2021 Hsu ..... F16L 37/20
11,388,997 B1 * 7/2022 Ghiorghie ..... A47B 57/56
2008/0035592 A1 * 2/2008 Yang ..... A47B 57/26 211/153
2012/0217215 A1 * 8/2012 Emery ..... A47K 3/281 24/570

* cited by examiner

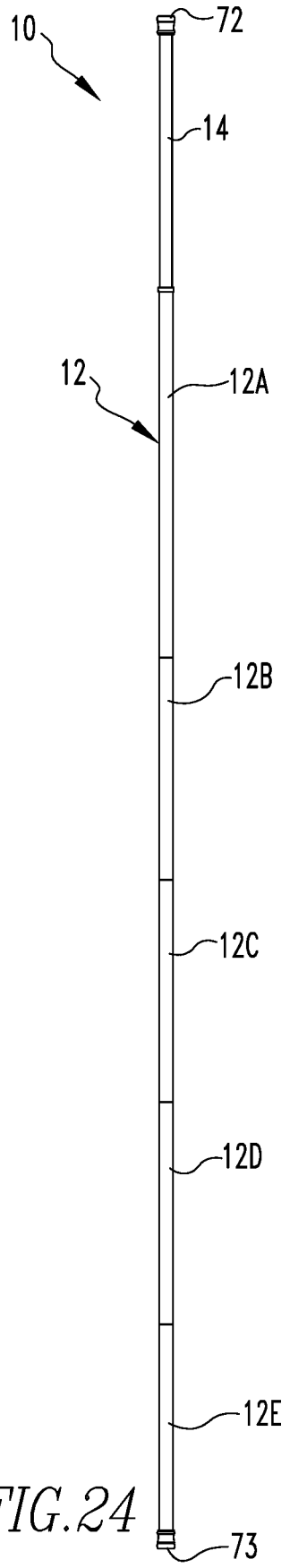
FIG.24
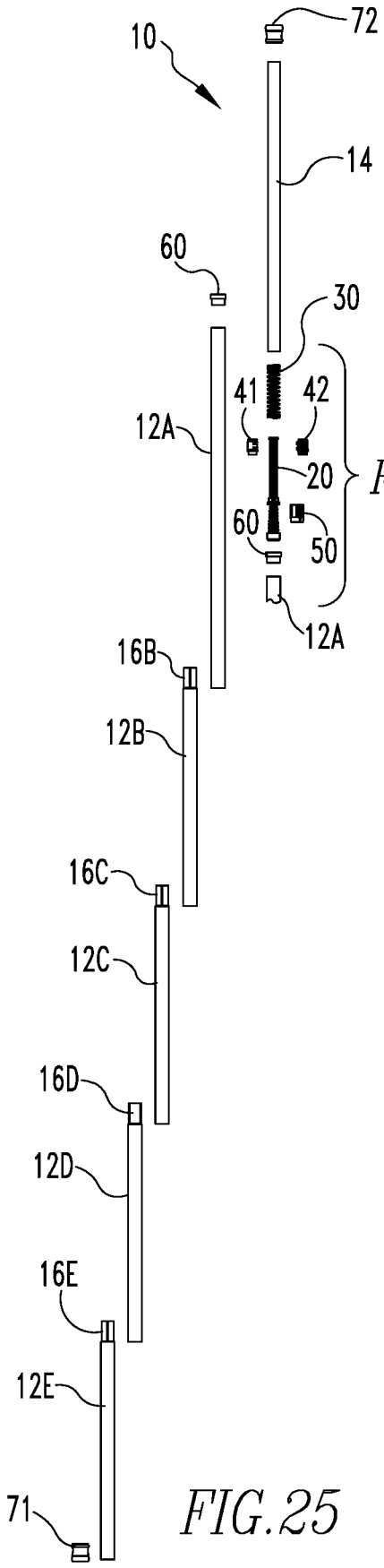
FIG.26
FIG.25

POLE CADDIES WITH ADJUSTABLE BASKET BRACKETS

CROSS-REFERENCE TO RELATED APPLICATION

This application claims the benefit of U.S. Provisional Patent Application No. 63/118,506 filed Nov. 25, 2020, which is incorporated herein by reference.

FIELD OF THE INVENTION

The present invention relates to pole caddies, and more particularly relates to bathroom pole caddies with baskets mounted on height-adjustable brackets.

BACKGROUND INFORMATION

Bathroom pole caddies with one or more baskets may be installed in bath and shower stalls. Typical pole caddies are installed as corner units with wire baskets attached to a vertical pole.

SUMMARY OF THE INVENTION

The present invention provides pole caddies with adjustable basket brackets that allow one or more baskets to be moved along the length of the pole and secured at desired heights. The adjustment bracket includes a cylindrical body with a central tube-receiving hole in which the pole is inserted. A bracket lever pivotally mounted on the body of the bracket is movable from a closed position in contact with the pole to an open position that allows the adjustable bracket to slide along the pole. The caddy pole may include a tension locking mechanism to hold the caddy in place when installed, and may include one or more tube sections.

An aspect of the present invention is to provide an adjustable pole caddy comprising a support tube, at least one adjustment bracket selectively positionable along an axial length of the support tube, and at least one adjustable basket mounted on the at least one adjustment bracket. The at least one adjustment bracket comprises a body comprising a tube-receiving hole extending therethrough structured and arranged to receive the support tube therein and a support housing extending radially outward from the tube-receiving hole, and a bracket lever movably mounted on the support housing from a closed position in which the adjustment bracket is prevented from moving along the axial length of the support tube to an open position in which the adjustment bracket is slidable along the axial length of the support tube. The bracket lever comprises a finger tab and a rear contact pad structured and arranged to contact the support tube when the bracket lever is in the closed position and to at least partially disengage from the contact with the support tube when the bracket lever is in the open position.

Another aspect of the present invention is to provide an adjustment bracket for adjustably mounting a height-adjustable basket on a pole caddy. The adjustment bracket comprises a body comprising a tube-receiving hole extending therethrough structured and arranged to receive a support tube of the pole caddy therein and a support housing extending radially outward from the tube-receiving hole, and a bracket lever movably mounted on the support housing from a closed position to an open position, the bracket lever comprising a finger tab and a rear contact pad comprising a pole contact surface that extends radially inward into the tube-receiving hole when the bracket lever is in the closed position, and is at least partially removed from the tube-receiving hole when the bracket lever is in the open position.

These and other aspects of the present invention will be more apparent from the following description.

BRIEF DESCRIPTION OF THE DRAWINGS

FIG. 24 is a side view of a caddy pole including multiple tube sections in accordance with an embodiment of the present invention.

FIG. 25 is an exploded side view of the caddy pole of FIG. 24.

DETAILED DESCRIPTION

Figure 1:
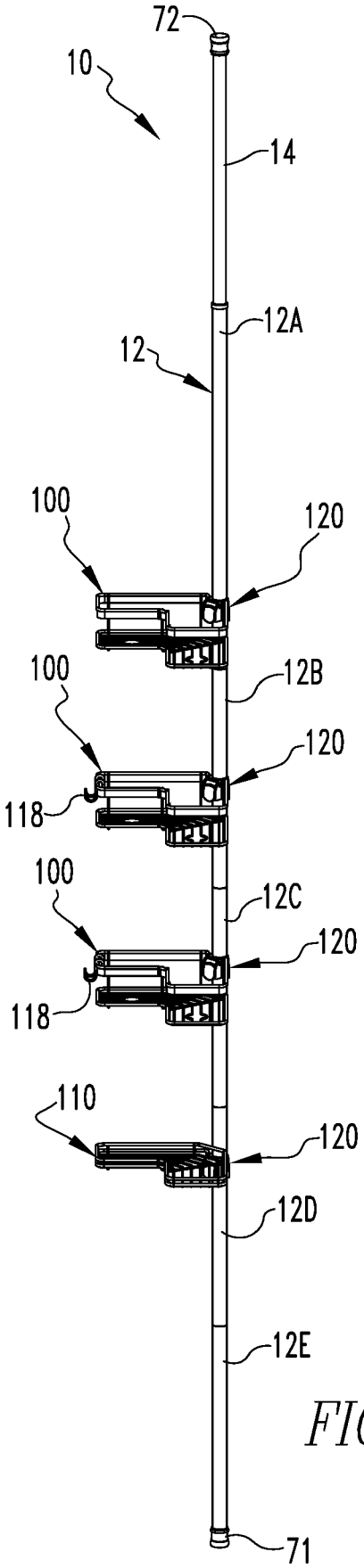
FIG. 1 is a side view of a pole caddy with height-adjustable baskets in accordance with an embodiment of the present invention.

FIGS. 1-4 illustrate an adjustable pole caddy 10 of the present invention. The pole caddy 10 may include at least one outer tube 12 and at least one inner tube 14 that may be installed between opposing floor and ceiling surfaces, such as in a bath or shower stall. Adjustable basket assemblies 100 are mounted on the outer tube 12 and/or inner tube 14, and are movable to selected heights along the vertical length of the pole caddy 10. An adjustable tray assembly 110 is also movably mounted on the pole caddy 10. As used herein, the term "basket" includes any type of basket, tray, shelf and the like that may be used to support or hold various items such as soap, shampoo and other bath products, bathroom accessories, wash cloths and the like.

As shown in FIGS. 1-4, the caddy pole may include a telescoping inner tube 14 provided at the top of the outer tube 12. As more fully described below, the inner tube 14 may be extended from the outer tube 12, and a locking spring tension mechanism may be used to provide tension that holds the adjustable pole caddy 10 in place. The outer tube 12 may be provided as a single tube, or may be provided in multiple sections, as more fully described below.

Figure 2:
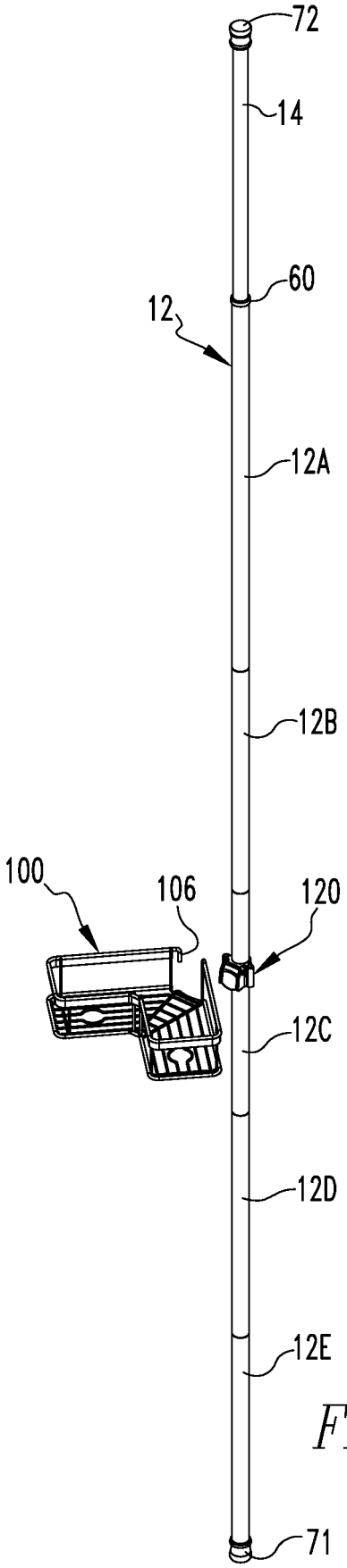
FIG. 2 is an isometric view of a pole caddy with an adjustable basket and adjustment bracket in accordance with an embodiment of the present invention.
Figure 3:
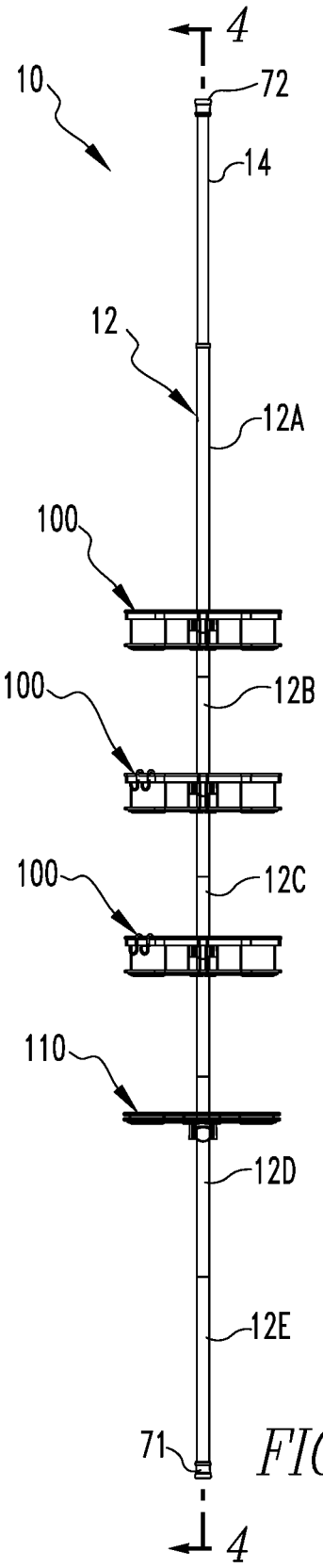
FIG. 3 is a front view of the adjustable pole caddy of FIG. 1.
Figure 4:
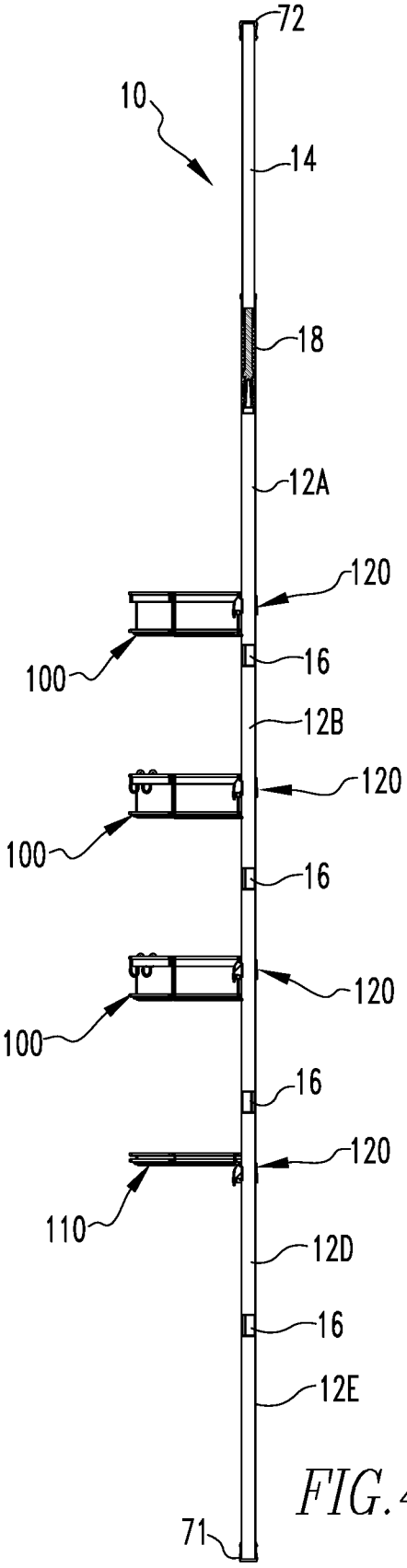
FIG. 4 is a side sectional view taken through section 4-4 of FIG. 3.
Figure 5:
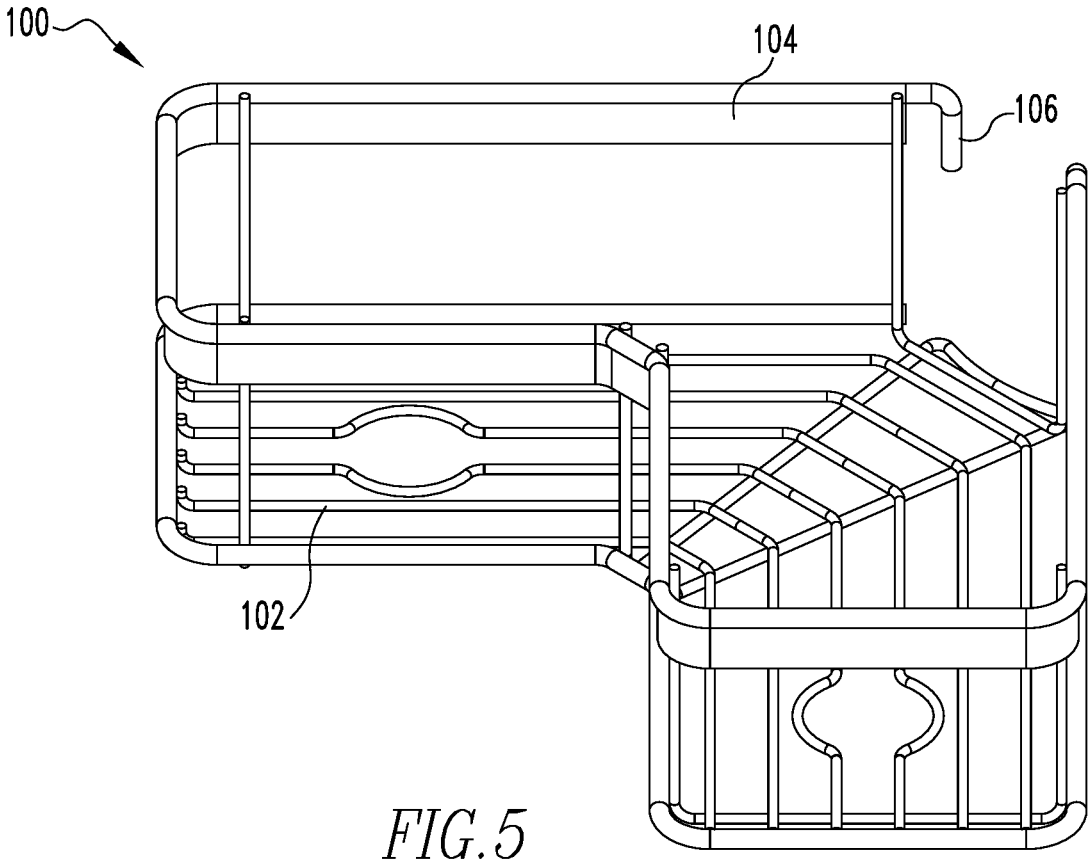
FIG. 5 is an isometric view of an adjustable basket for a pole caddy in accordance with an embodiment of the present invention.
Figure 6:
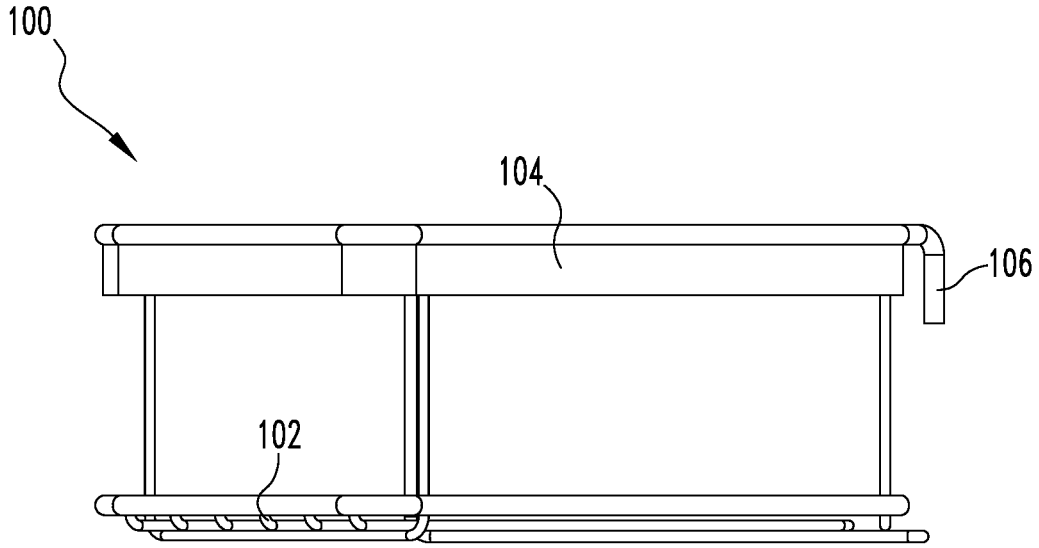
FIG. 6 is a side view of the adjustable basket of FIG. 5.
Figure 7:
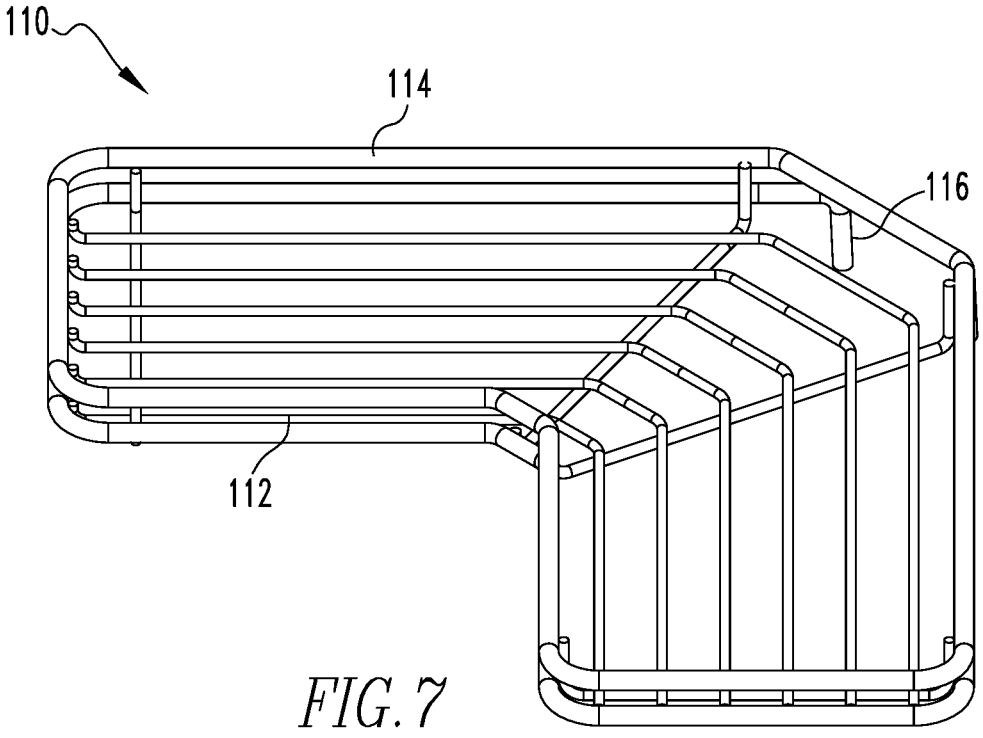
FIG. 7 is an isometric view of an adjustable tray for a pole caddy in accordance with an embodiment of the present invention.
Figure 8:
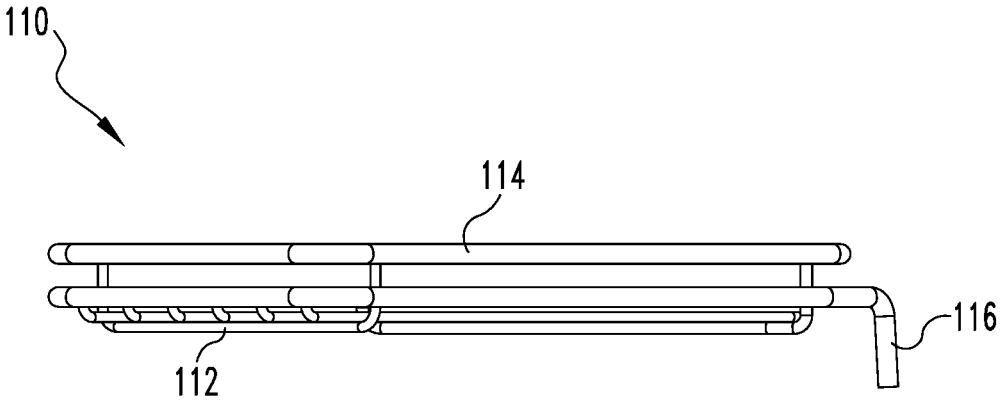
FIG. 8 is a side view of the adjustable tray of FIG. 7.
Figure 9:
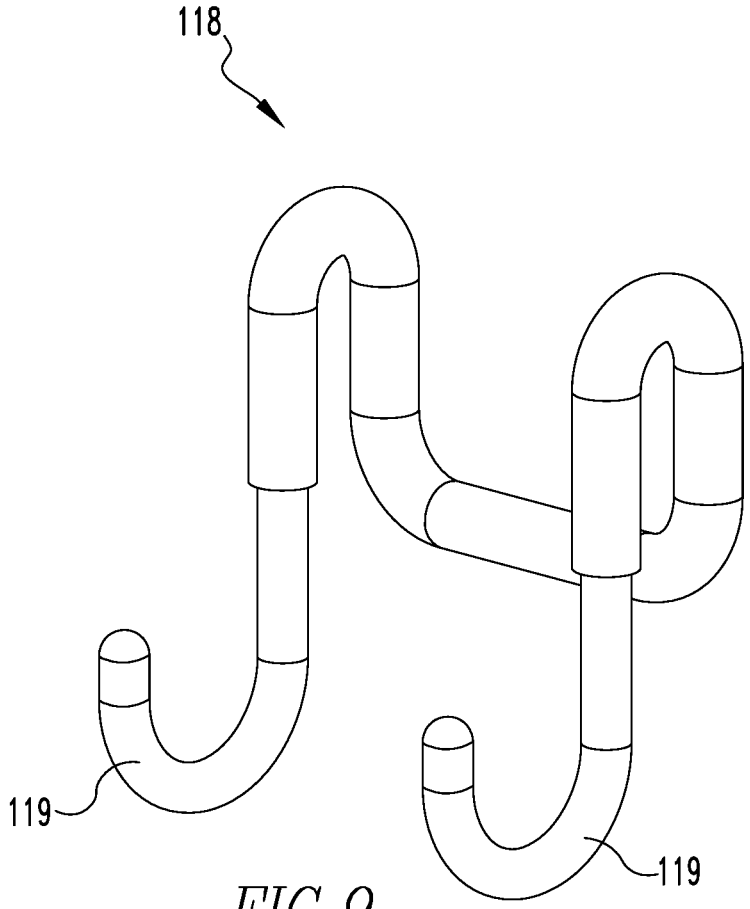
FIG. 9 is an isometric view of a hook bracket that may be mounted on adjustable pole caddy baskets and/or trays in accordance with embodiments of the present invention.

Each adjustable basket assembly 100 includes a wire base 102, side rail 104 and support pins 106, as shown in FIGS. 2, 5 and 6. The support pins 106 extend vertically downward and are insertable in an adjustment bracket 120, as more fully described below. The adjustable tray assembly 110 includes a wire base 112, side rail 114 and support pins 116, which may be inserted into an adjustment bracket 120. As shown in FIGS. 1, 3, 4 and 9, detachable hook brackets 118 with one or more hooks 119 may be removably mounted on the wire basket(s) 100 and/or wire tray(s) 110.

FIGS. 1-4 and 10-23 illustrate an adjustable bracket 120 and components thereof in accordance with an embodiment of the present invention. The adjustment bracket 120 includes a generally cylindrical body 122 with a central tube-receiving hole 123, support columns 124 with pin-receiving holes 125 located on opposite sides of the cylindrical body 122, and a front support housing 126 upon which a bracket lever 130 is pivotally mounted. The support housing 126 includes mounting holes 127 and stop tabs 128. The bracket lever 130 includes mounting pins 132 that are inserted in the mounting holes 127 of the support housing 126. The bracket lever 130 includes a front finger tab 134, a concave rear contact pad 136, and a top retaining ridge 138. As shown in FIGS. 2-4, an adjustable basket 100 may be installed on and supported by the adjustment bracket 120 by inserting the support pins 106 into the pin-receiving holes 125 of the support columns 124 of the adjustment bracket 120. Although a support pin arrangement is shown, it is to be understood that any other suitable means for attaching the adjustable basket 100 and/or tray 110 to the adjustment bracket 120 may be used.

Figure 10:
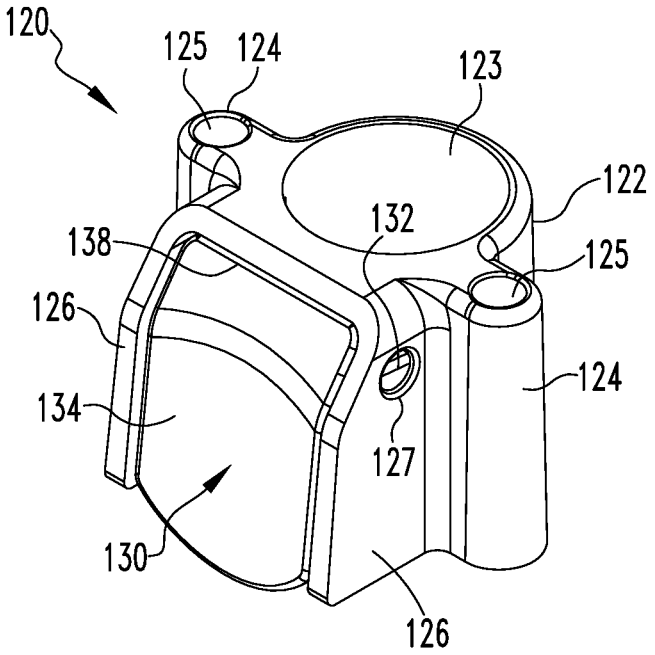
FIG. 10 is an isometric view of an adjustment bracket for use on pole caddies in accordance with an embodiment of the present invention.
Figure 11:
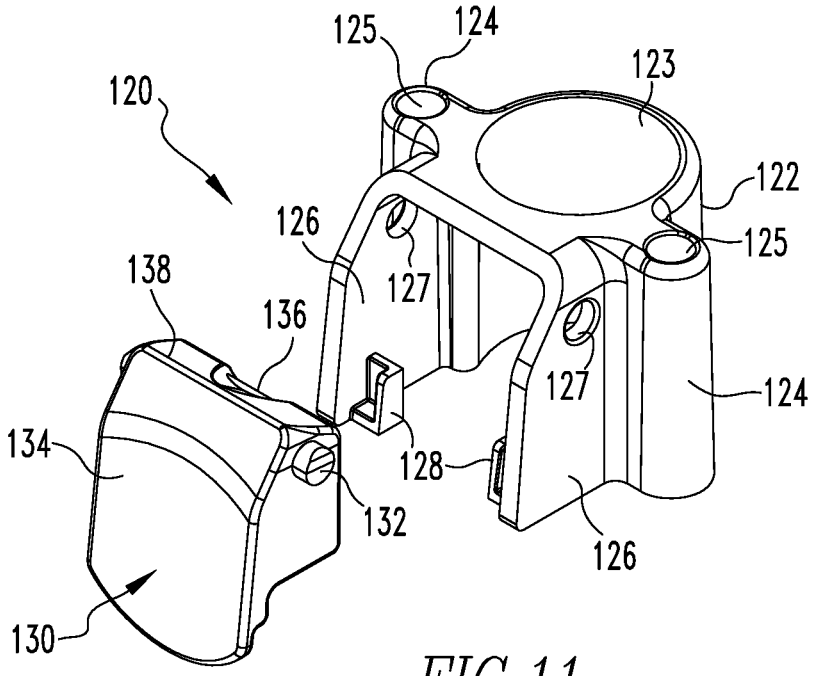
FIG. 11 is an exploded isometric view of the adjustment bracket of FIG. 10.
Figure 12:
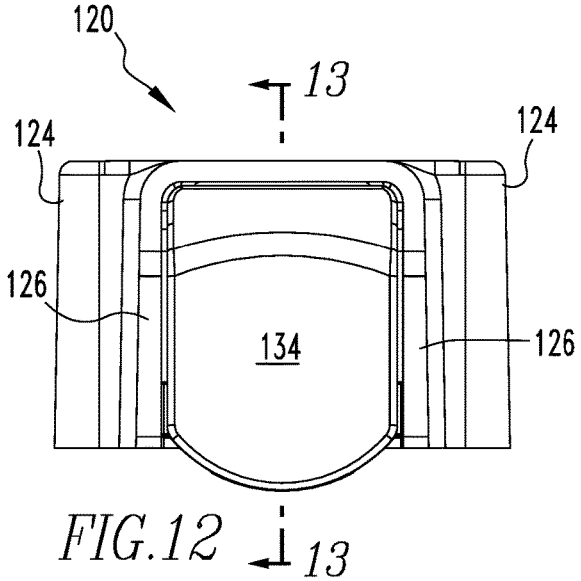
FIG. 12 is a front view of the adjustment bracket of FIG. 10.
Figure 13:
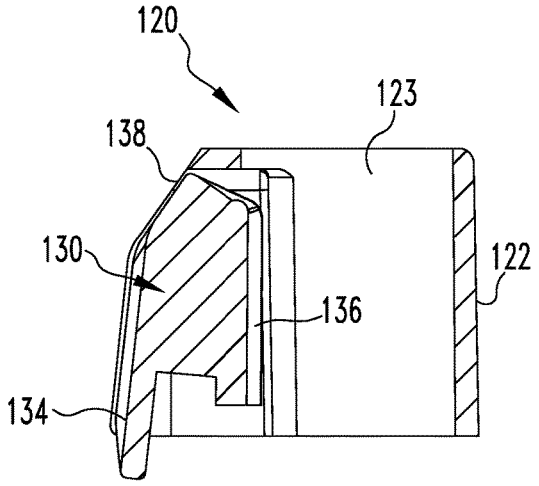
FIG. 13 is a side sectional view taken through section 13-13 of FIG. 12.
Figure 14:
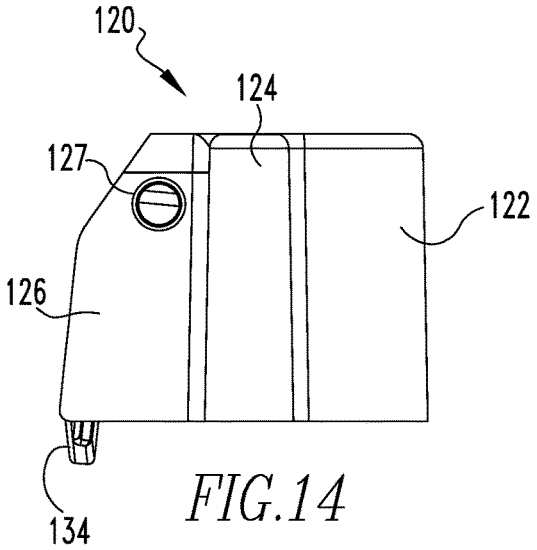
FIG. 14 is a side view of the adjustment bracket of FIG. 10.
Figure 15:
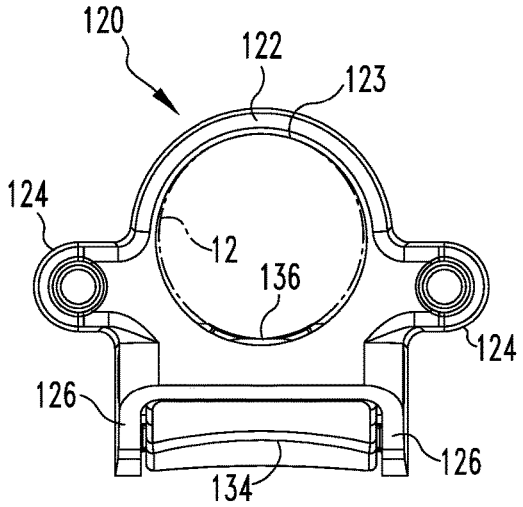
FIG. 15 is a top view of the adjustment bracket of FIG. 10 installed on a caddy pole support tube.
Figure 16:
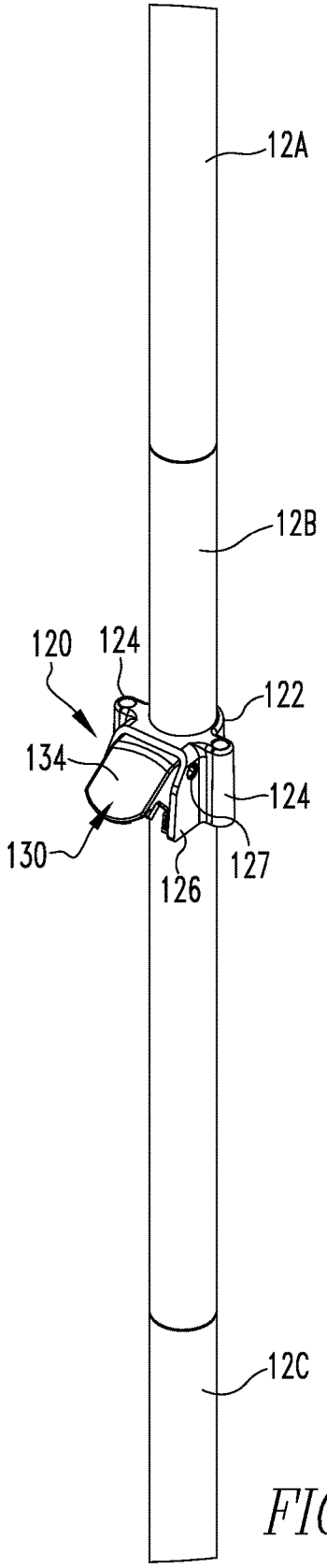
FIG. 16 is isometric view of an adjustment bracket mounted on a caddy pole in an open position which allows the adjustment bracket to adjustably slide along the length of the caddy pole.
Figure 17:
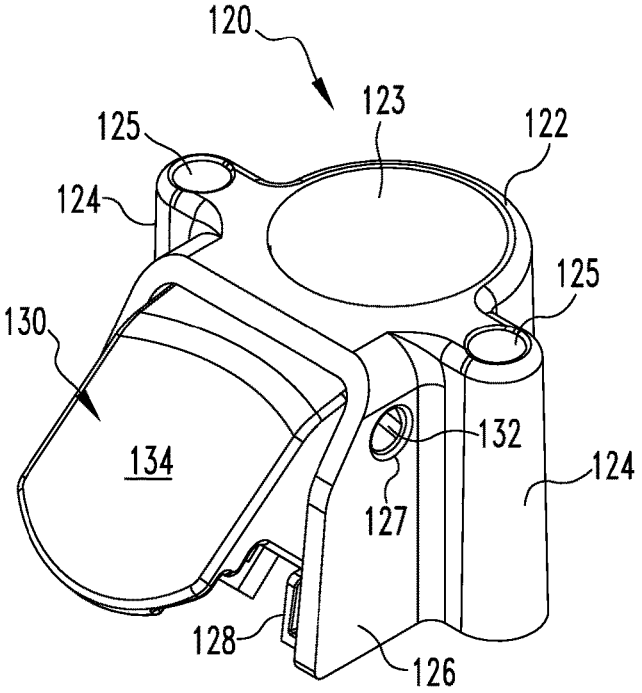
FIG. 17 is an isometric view of the open adjustment bracket of FIG. 16.
Figure 18:
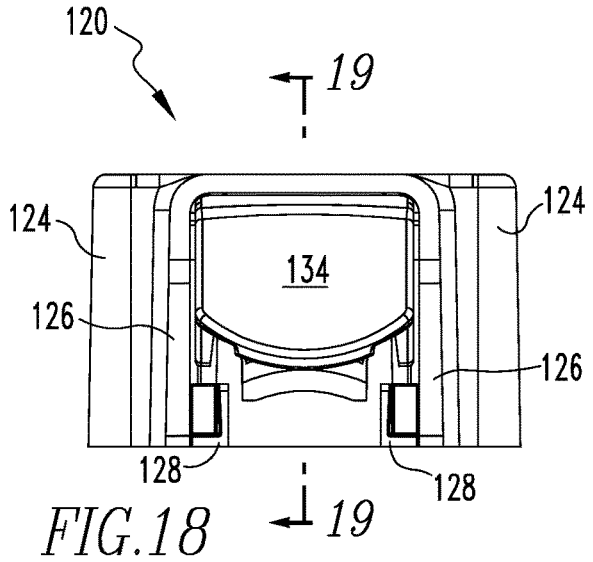
FIG. 18 is a front view of the open adjustment bracket of FIG. 17.
Figure 19:
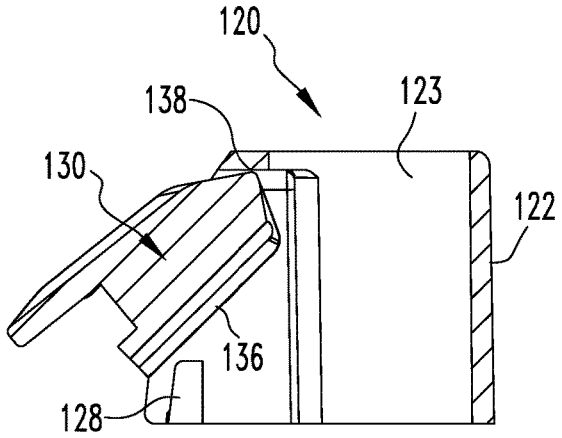
FIG. 19 is a side sectional view taken through section 19-19 of FIG. 18.
Figure 20:
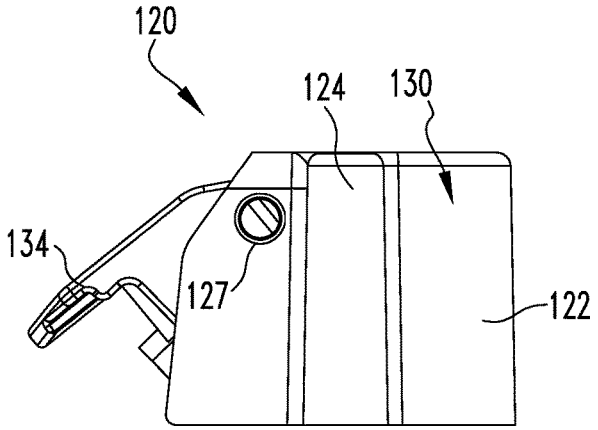
FIG. 20 is a side view of the open adjustment bracket of FIG. 17 installed on a caddy pole support tube.

As shown by comparing FIGS. 10-15 with FIGS. 16-21, the finger tab 134 of the bracket lever 130 may be pivotally raised from the closed position shown in FIG. 10 to the open position shown in FIG. 17 to unlock the adjustment bracket 120 from the outer pole 12, thereby allowing the adjustment bracket 120 and adjustable basket 100 to move vertically along the length of the outer pole 12 to a desired height. The adjustment bracket 120 may then be locked in a desired position by pressing and rotating the finger tab 134 inward toward the outer pole 12. When the bracket lever 130 is in the closed position, such as shown in FIGS. 10-15, the generally cylindrical rear contact pad 136 of the bracket lever 130 extends radially into the cylindrical body 122 for engagement with the outer pole 12. In this position, frictional engagement between the conforming surfaces of the generally cylindrical rear contact pad 136 and outer pole 12, aided by the weight of the adjustable basket 100, keeps the adjustable bracket 120 and adjustable basket 100 in a fixed position on the outer pole 12.

Figure 21:
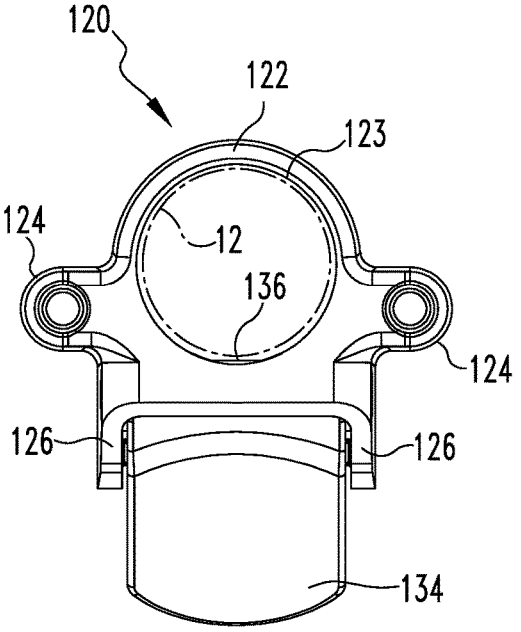
FIG. 21 is a top view of the open adjustment bracket of FIG. 17.
Figure 22:
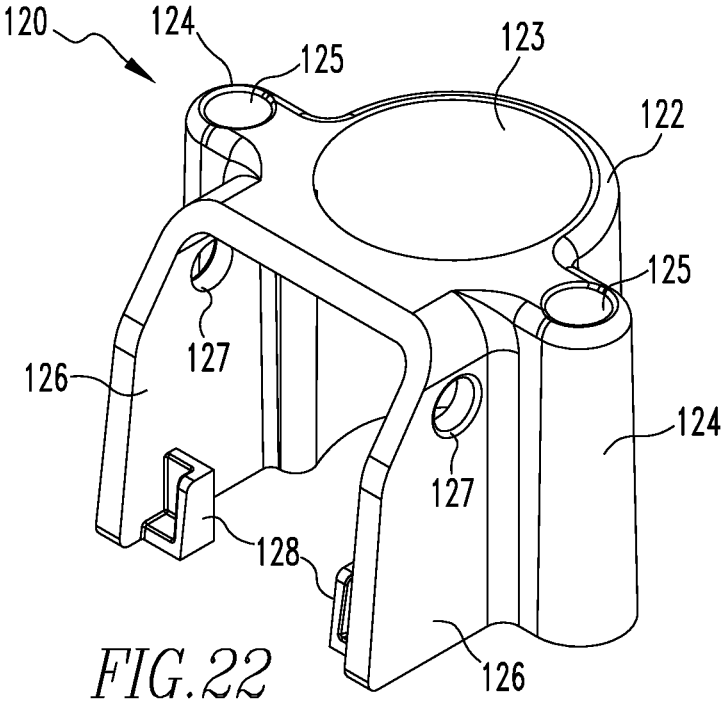
FIG. 22 is an isometric view of a housing of the adjustment bracket of FIGS. 10 and 17.
Figure 23:
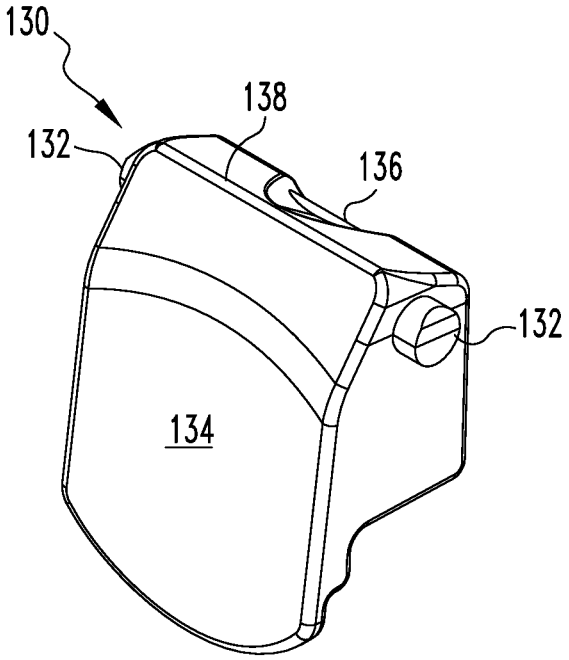
FIG. 23 is an isometric view of a bracket lever of the adjustment bracket of FIGS. 10 and 17.
Figure 26:
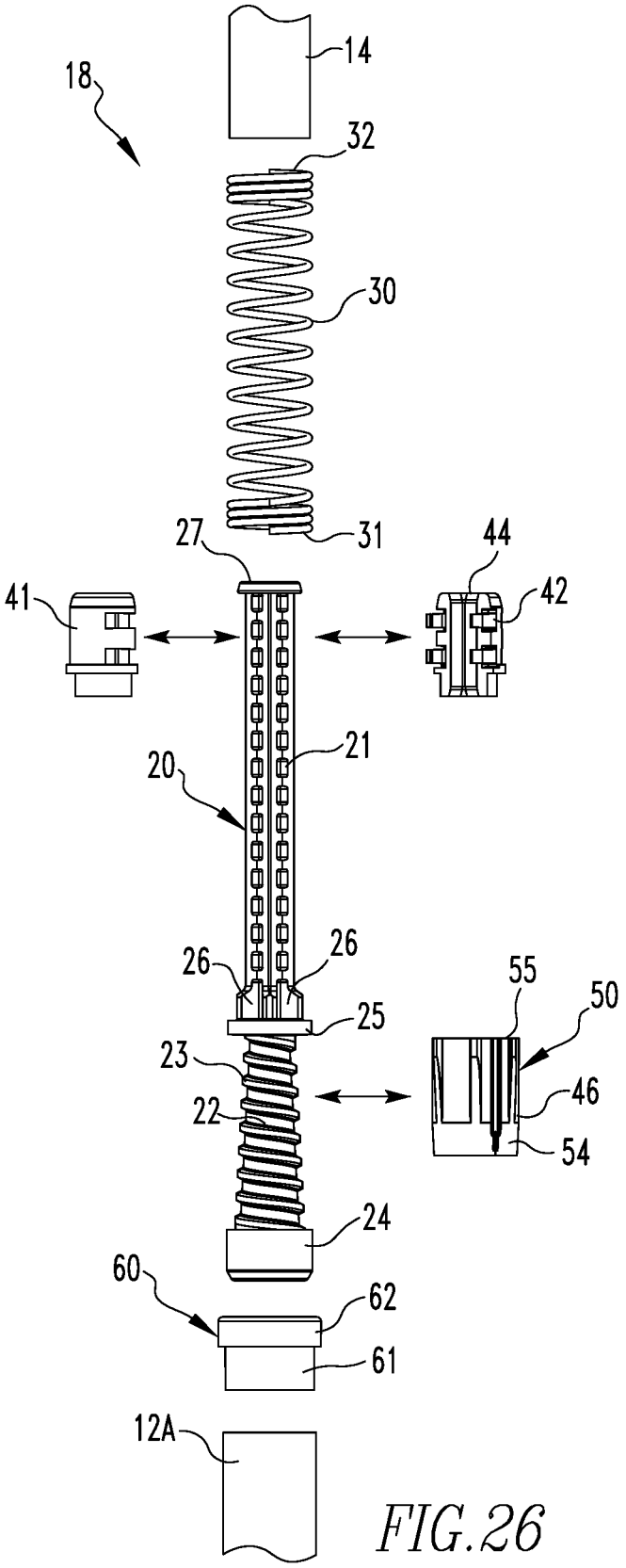
FIG. 26 is an exploded side view of a tension lock assembly that may be used in a caddy pole in accordance with an embodiment of the present invention.
Figure 27:
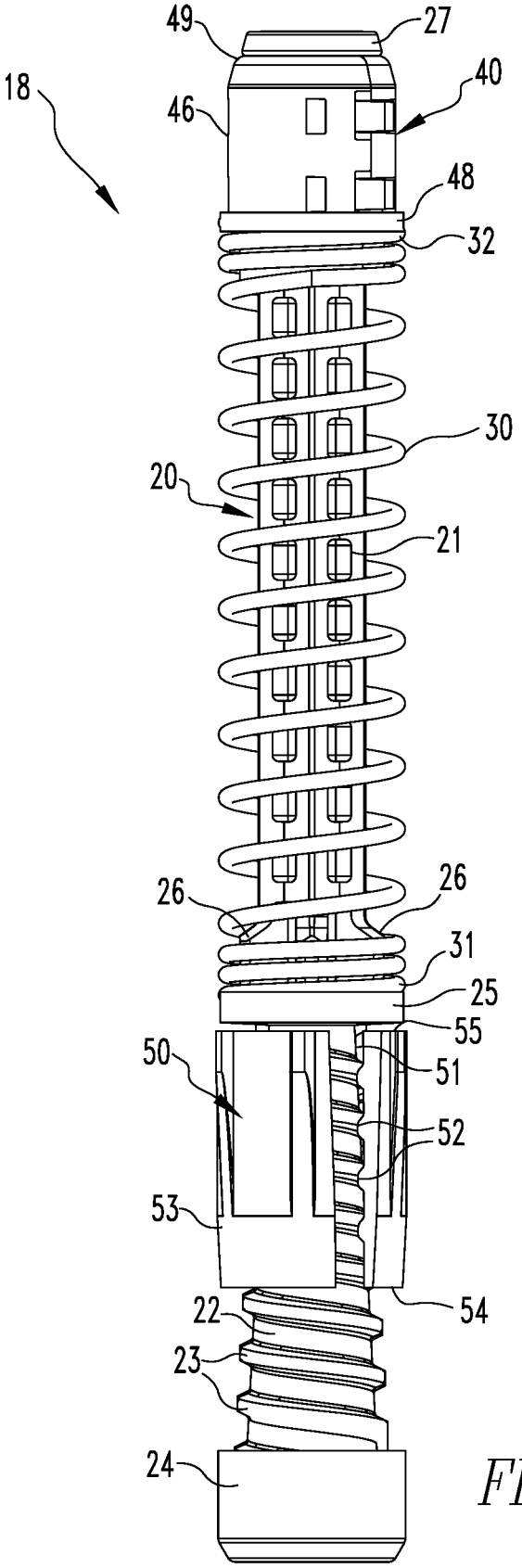
FIG. 27 is a side view of the tension lock assembly of FIG. 26.

In FIGS. 16-21, the bracket lever 130 and finger tab 134 have been moved to a fully open position in which the rear contact pad 136 is separated from the outer pole 12. As can be seen in FIG. 21, the rear contact pad 136 is almost entirely removed from the tube-receiving hole 123 in the open position. This allows the user to adjust the height of the basket 100 by sliding the adjustment bracket 120 up or down the pole 12 to a desired position. Once the adjustment bracket 120 and basket 100 are at a desired height, the finger tab 134 may be pressed inward to press the contact pad 136 against the pole 12 and lock the adjustment bracket 120 and basket 100 into position.

When the bracket lever 130 and finger tab 134 are in the locked position in which the semi-cylindrical surface of the rear contact pad 136 contacts the cylindrical outer pole 12, a slight gap may exist between the top retaining ridge 138 and an underside of the support housing 126. In an alternative embodiment, when the bracket lever 130 and finger tab 134 are in the closed position shown in FIGS. 10-15, the top retaining ridge 138 may come into contact with the underside of the support housing 126 (not shown) to create frictional resistance that helps hold the bracket lever 130 in the closed position. In such an alternative embodiment, rotation of the bracket lever 130 and finger tab 134 toward the open position results in disengagement between the top retaining ridge 138 and the underside of the support housing 126, thereby reducing or eliminating frictional rotational resistance as the bracket lever 130 and finger tab 134 are moved from the closed position toward the open position.

FIGS. 24-27 further illustrate details of an embodiment of the adjustable pole caddy 10 in which outer tube 12 includes multiple outer tube sections 12A, 12B, 12C, 12D and 12E, and the pole caddy 10 includes a tension lock assembly 18 for securing the outer tube 12 and inner tube 14 together to provide an adjustable telescoping tension rod assembly.

The tension lock assembly 18 includes a retaining rod 20 having a spring retaining bar 21 of non-circular cross section, a tapered threaded portion 22 having exterior threads 23, a tapered end cap 24, a mid separator flange 25, spring retaining webs 26, and a spring retaining bar end cap 27. The tapered threaded portion 22 is insertable in the outer tube 12, and the non-circular retaining bar 21 is insertable in the inner tube 14. The tension lock assembly 18 includes a spring 30 surrounding the spring retaining bar 21. The spring 30 has a first end 31 that fits over the spring retaining webs 26 and abuts the spring retaining bar end cap 27. The spring 30 has a second end 32 that abuts an anti-rotation collar 40, as more fully described below.

The anti-rotation collar 40 is inserted in the end of the inner tube 14 and may be secured within the inner tube 14 by means of an indented dimple (not shown), or any other suitable fastening means such as crimping, press-fitting, mechanical fasteners and adhesives. The anti-rotation collar 40 has a generally cylindrical outer sidewall 46, an end flange 48 at one end and an insertion nose 49 at the opposite end from the end flange 48. A non-circular through hole 44 extends through the anti-rotation collar 40 in an axial direction of the collar. The non-circular through hole 44 of the anti-rotation collar 40 allows the non-circular spring retaining bar 21 to move axially within the inner tube 14, but prevents the spring retaining bar 21 and retaining rod 20 from rotating around the longitudinal axis of the inner tube 14. Although square cross-sections are shown in the figures for the non-circular retaining bar 21 of the spring retaining rod 20 and the non-circular hole 44 of the anti-rotation collar 40, any other suitable cross-sectional shape may be used that prevents relative rotation therebetween.

The anti-rotation collar 40 includes a first half 41 and a second half 42 that are secured around the spring retaining bar 21 adjacent to the spring retaining bar end cap 27 of the retaining rod 20. With the anti-rotation collar 40 surrounding the spring retaining bar 21 of the retaining rod 20, the end flange 48 of the anti-rotation collar 40 abuts the second end 32 of the spring 30.

The split locking sleeve 50 includes a tapered interior opening 51, interior threads 52, a generally cylindrical outer sidewall 53, a first end 54 and, a second end 56. The split locking sleeve 50 surrounds the tapered threaded portion 22 of the retaining rod 20. The interior threads 52 of the locking sleeve 50 engage the exterior threads 23 of the tapered threaded portion 22. The split locking sleeve 50 is threadingly movable along the axial length of the tapered threaded portion 22 between one position in which the first end 54 is adjacent to the tapered end cap 24 and another position in which the second end 55 is adjacent to the separator plate 25. When the split locking sleeve 50 is threaded toward the tapered end cap 24, its outer sidewall 53 expands radially outward to contact and press against an inner wall of the outer tube 12A. The tapered external threads of the spring-retaining rod 20 and the tapered internal threads of the split locking sleeve 50 engage with each other in a manner such that relative rotation of the outer and inner tubes 12 and 14 around their central longitudinal axis expands the outer diameter of the split cam nut 50 against the inner surface of the outer tube 12 to thereby releasably lock the spring-retaining rod 20 in a fixed axial position with respect to the outer tube 12.

With the outer tube 12 and retaining rod 20 locked together against relative axial movement, spring tension is still provided for the rod assembly 10 by allowing the spring-retaining rod 20 to slide axially within the non-circular hole 44 of the anti-rotation collar 40 and within the inner tube 14, against the force of the tension spring 30 as it is compressed between the mid separator flange 25 of the spring-retaining rod 20 and the opposing abutment end of the anti-rotation collar 40.

A protective end sleeve 60 is inserted in the end of the outer tube 12 in order to guide and protect the inner tube 14 as it telescopingly slides in the outer tube 12. The end sleeve 60 has a cylindrical body 61 and an end flange 62. The adjustable tension rod assemblies 10 may include first and second end caps, such as first and second end caps 71 and 72 shown in FIGS. 1, 2, 24 and 25.

Figure 28:
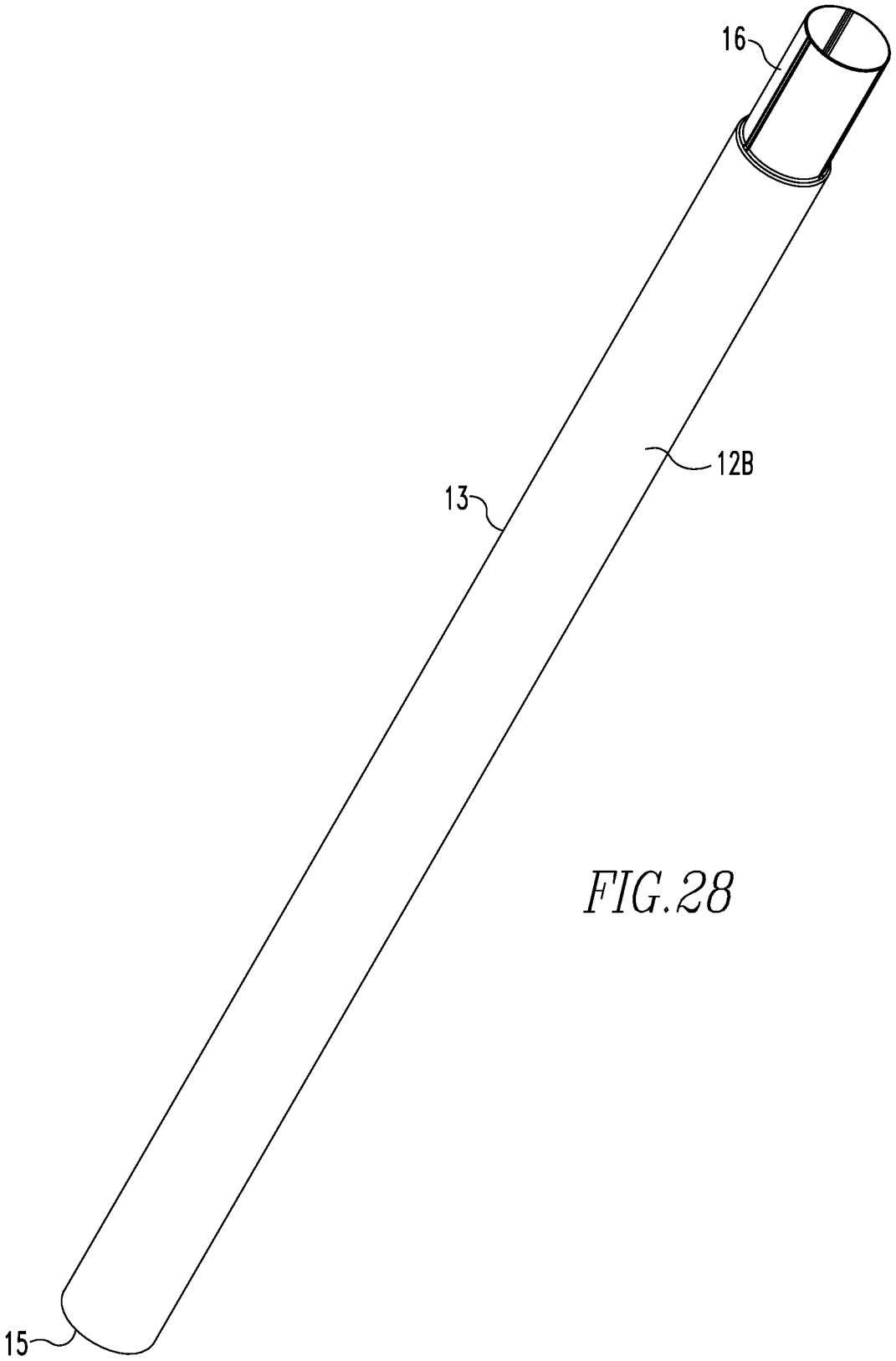
FIG. 28 is an isometric view of a section of a pole caddy tube in accordance with an embodiment of the present invention.

FIG. 28 illustrates the second outer tube section 12B having a cylindrical outer tube sidewall 13. A first end 15 of the outer tube section 12B has an outer diameter corresponding to the outer diameter of the cylindrical sidewall 13. A second end 16 of the outer tube section 12B has a decreased outer diameter forming a connection insert 16 that may be inserted into the end of the first outer tube section 12A.

As shown in FIGS. 1, 2, 24, 25 and 28, the adjustable pole caddy 10 may optionally be provided in the form of a multi-segment tube assembly in which two sections of the tubing include the first outer tube section 12A and inner tube 14, respectively, and additional tube sections 12B-E with narrowed or swaged ends are provided. The swaged end of each tube section 12B-E is inserted and secured in a cylindrical non-swaged end of an adjacent tube section 12A-D to form the tube assembly. Although four swaged tubes are shown in FIGS. 1, 2, 24 and 25, any other suitable number of swaged tubes may be used, e.g., from zero to 6 or more. The multi-segment adjustable tension rod assembly facilitates storage and shipping of the assemblies by decreasing the overall packaging lengths. Although the outer and inner tubes 12 and 14 are shown at one end of the multi-segment adjustable tension rod assembly in the figures, any other suitable arrangement may be used, for example, the outer and inner tubes 12 and 14 and associated tension mechanism 18 may be provided at either end of the multi-segment adjustable tension rod assembly, or may be provided in the middle of the assembly with one or more swaged tube sections removably attached to the end of each outer and inner tube 12 and 14. Although the ends of selected tube sections are swaged or narrowed in the embodiment shown in FIGS. 24, 25 and 28, any other suitable attachment means may be used, such as radially extending retractable pins and radial pin-receiving holes at the ends of adjoining tube sections, and the like.

The components of the adjustable tension rod assemblies of the present invention may be made from any suitable materials. For example, the outer and inner tubes 12 and 14, any additional swaged or narrowed tube segments, the wire baskets and trays 100 and 110, and detachable brackets 118 and hooks 119 may be made of metal such as steel, aluminum and the like, or polymeric materials such as high-density polyethylene (HDPE) and the like. The spring-retaining rod 20, split anti-rotation collar 40, guide ring 60, end caps 71 and 72, and adjustable bracket 120 may be made of metal or polymeric materials such as nylon, HDPE, polycarbonate, polystyrene, polypropylene, acrylonitrile butadiene styrene (ABS), styrene acrylonitrile (SAN), polyurethane, polyvinyl chloride (PVC), rubber and the like. The tension spring 30 may be made of steel and the like. The split locking sleeve 50 may be made of synthetic or natural rubber, e.g., of low durometer, as well as other materials such as polycarbonate, polystyrene, polypropylene, ABS, SAN, polyurethane, PVC and the like.

The adjustable pole caddies 10 of the present invention may be easily installed between opposing ceiling and floor surfaces by sliding the inner tube 14 out from the outer tube 12 until the total length of the caddy pole is slightly larger than the distance between the opposing surfaces, for example, from 0.5 to 4 inches larger, from 1 to 3 inches larger, or from 1.5 to 2.5 inches larger. The outer and inner tubes 12 and 14 are then twisted relative to each other around their longitudinal axis to thereby expand the outer diameter of the split locking sleeve 50 against the inner surface of the outer tube 12, and to releasably lock the spring-retaining rod 20 in a fixed axial position with respect to the outer tube 12. The pole caddy 10 is then installed between the opposing surfaces by compression of the spring 30. In the installed position, spring tension holds the pole caddy 10 in place.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. An adjustable pole caddy comprising:

a support tube;

at least one adjustment bracket selectively positionable along an axial length of the support tube; and at least one adjustable basket mounted on the at least one adjustment bracket, wherein the at least one adjustment bracket comprises:

a single-piece body comprising a tube-receiving hole extending therethrough structured and arranged to surround and receive the support tube therein and a support housing extending radially outward from the tube-receiving hole; and a bracket lever pivotally mounted on the support housing from a closed position in which a portion of the bracket lever extends radially into the tube-receiving hole and directly contacts the support tube to thereby prevent the adjustment bracket from moving along the axial length of the support tube to an open position in which the portion of the bracket lever is at least partially removed from the tube-receiving hole and the adjustment bracket is slidable along the axial length of the support tube, the bracket lever comprising a front finger tab and a rear contact pad integrally formed with the front finger tab structured and arranged to directly contact the support tube when the bracket lever is in the closed position and to at least partially disengage from the direct contact with the support tube when the bracket lever is in the open position.

2. The adjustable pole caddy of claim 1, wherein the body of the adjustment bracket is substantially cylindrical.

3. The adjustable pole caddy of claim 2, wherein the body comprises at least one support column comprising a pin-receiving hole extending along an axial length of the substantially cylindrical body.

4. The adjustable pole caddy of claim 3, wherein the body comprises two of the support columns located at opposite radial sides of the substantially cylindrical body.

5. The adjustable pole caddy of claim 4, wherein the at least one adjustable basket comprises two support pins, and each support pin is insertable into the pin receiving hole of one of the support columns.

6. The adjustable pole caddy of claim 1, wherein the tube-receiving hole of the body is substantially cylindrical.

7. The adjustable pole caddy of claim 1, wherein the support housing comprises two axially aligned pivot mounting holes, the bracket lever comprises two axially aligned pivot mounting pins, and each of the pivot mounting pins is inserted in one of the pivot mounting holes.

8. The adjustable pole caddy of claim 1, wherein the support housing comprises at least one stop tab structured and arranged to contact the bracket lever when the bracket lever is in the closed position.

9. The adjustable pole caddy of claim 8, wherein the housing comprises two of the stop tabs.

10. The adjustable pole caddy of claim 1, wherein the rear contact pad comprises a concave pole contact surface.

11. The adjustable pole caddy of claim 1, wherein the rear contact pad comprises a generally cylindrical pole contact surface.

12. The adjustable pole caddy of claim 11, wherein the generally cylindrical pole contact surface extends radially inward into the tube-receiving hole when the bracket lever is in the closed position to thereby contact and press against an outer cylindrical surface of the support tube.

13. The adjustable pole caddy of claim 12, wherein the generally cylindrical pole contact surface is at least partially removed from the tube-receiving hole when the bracket lever is in the open position.

14. The adjustable pole caddy of claim 1, wherein the support tube comprises an outer tube and an inner tube telescopingly slidable in the outer tube.

15. The adjustable pole caddy of claim 14, further comprising a tension lock assembly structured and arranged to selectively axially position the outer and inner tubes in relation to each other.

16. The adjustable pole caddy of claim 14, wherein the outer tube comprises first and second outer tube sections, and the second outer tube section has a reduced diameter end structured and arranged for removable insertion into an end of the first outer tube section.

* * * * *